US007748527B2

(12) United States Patent
Wisecarver et al.

(10) Patent No.: US 7,748,527 B2
(45) Date of Patent: Jul. 6, 2010

(54) PANEL PACKAGING SYSTEM

(75) Inventors: Mark A. Wisecarver, Morristown, TN (US); John R. Marquardt, Fond du Lac, WI (US); Philip A. Blankenship, Talbott, TN (US); Mike Gammons, Union City, TN (US); Buddy J. Thompson, Union City, TN (US); Chris C. Beardsley, Bardwell, KY (US); Tobin J. Vetting, Sheboygan Falls, WI (US); Jason M. Roman, Sheboygan, WI (US); Kenneth S. Bashore, Clarksville, TN (US)

(73) Assignee: Kohler Co., Kohler, WI (US)

( * ) Notice: Subject to any disclaimer, the term of this patent is extended or adjusted under 35 U.S.C. 154(b) by 98 days.

(21) Appl. No.: 11/955,722

(22) Filed: Dec. 13, 2007

(65) Prior Publication Data

US 2008/0148692 A1 Jun. 26, 2008

Related U.S. Application Data

(60) Provisional application No. 60/875,209, filed on Dec. 15, 2006.

(51) Int. Cl.
*B65D 85/46* (2006.01)
*B65D 85/48* (2006.01)

(52) U.S. Cl. ..... 206/321; 206/325; 206/453

(58) Field of Classification Search ..... 206/588, 206/586, 455, 453, 449, 521, 321, 325, 443, 206/451; 229/167, 117.13
See application file for complete search history.

(56) References Cited

U.S. PATENT DOCUMENTS

| | | | | | |
|---|---|---|---|---|---|
| 1,715,533 | A | * | 6/1929 | Bowersock | 206/449 |
| 2,005,967 | A | * | 6/1935 | Berdan | 206/454 |
| 2,501,609 | A | | 3/1950 | Midouhas | |
| 2,925,211 | A | * | 2/1960 | Frankenstein | 229/167 |
| 3,602,367 | A | * | 8/1971 | Nathan et al. | 206/454 |
| 4,127,188 | A | | 11/1978 | Heaney | |
| 4,320,839 | A | * | 3/1982 | Skaggs | 229/167 |
| 4,429,791 | A | | 2/1984 | Ruppel et al. | |
| 4,884,687 | A | | 12/1989 | Steves | |
| 4,967,905 | A | | 11/1990 | Steves | |
| 5,076,432 | A | | 12/1991 | Wolf | |
| 5,341,934 | A | * | 8/1994 | Hsu | 206/521 |
| 5,385,238 | A | * | 1/1995 | Lancaster et al. | 206/588 |
| 5,873,516 | A | * | 2/1999 | Boggs | 229/117.13 |
| 6,382,422 | B1 | * | 5/2002 | Bocek | 206/586 |
| 7,080,772 | B2 | * | 7/2006 | Lebras | 229/167 |
| 2005/0045646 | A1 | | 3/2005 | White | |
| 2005/0115860 | A1 | | 6/2005 | Mertz et al. | |

FOREIGN PATENT DOCUMENTS

| | | |
|---|---|---|
| GB | 1210500 | 10/1970 |
| WO | PCT/US2007/024990 | 6/2007 |

* cited by examiner

*Primary Examiner*—Ehud Gartenberg
*Assistant Examiner*—Kaushikkumar Desai
(74) *Attorney, Agent, or Firm*—Quarles & Brady LLP

(57) ABSTRACT

Packaging for one or more shower doors is provided where the doors are displayed to the consumer at the time of sale while associated hardware/header rails are secured from view, vandalism, and theft. The packaging provides a buffering frame around the doors. There are lateral wrap structures that retain the hardware and header rails, and end caps that provide locking cradles for the ends of the doors.

5 Claims, 11 Drawing Sheets

PANEL PACKAGING SYSTEM

CROSS-REFERENCE TO RELATED APPLICATION

This application claims benefit to U.S. Provisional Application Ser. No. 60/875,209, filed Dec. 15, 2006.

STATEMENT OF FEDERALLY SPONSORED RESEARCH OR DEVELOPMENT

Not applicable.

BACKGROUND OF THE INVENTION

The present invention relates to packaging systems useful for transporting and displaying shower doors and/or other panel structures. More particularly, it relates to such packaging configured to display the panel(s) to a consumer at the time of sale while also safeguarding the panel(s) and associated hardware during transit and at the time of sale.

Many products are packaged in boxes that fully enclose the product therein. While this typically protects the packaged product quite well during shipment, consumers may not be fully satisfied as to the nature of the product when such packaging is used, particularly when the package is made of an opaque material such as cardboard. This can lead to lower sales. Alternatively, it may lead to consumers opening up packages at the retailer when considering whether to buy.

Where the latter occurs and the consumer nevertheless decides not to buy the product, the retailer can then be left with an opened package. Another consumer seeing an opened box may assume that it is a returned item, or a floor model, or otherwise perceive the product as suspect. As a result, retailers can be left with opened boxes that will not sell absent substantial discounts.

Further, once a fully enclosing box has been opened there is a greater likelihood of theft or vandalism. For example, someone needing an item of replacement hardware to make a repair may try to steal the appropriate part from a box if they see an opened box that they know houses the part.

A variety of packages have been developed which have windows, openings, or transparent housings to show consumers the essential nature of the product they are considering purchasing. However, where transparent packaging materials such as plastics are used to permit the product to be viewed from outside the package, this can increase costs (e.g., relative to the use of cardboard). The alternative of leaving an opening in the box (without any covering), while clearly allowing the consumer to better appreciate the nature of the packaged product, can in some cases fail to adequately protect the product during shipment, and in any event will increase the risk of theft of small parts that are now visible as well.

As packaging becomes more complex to address these additional concerns, the cost of using and creating the packaging also grows.

Hence, a need still exists for improved packaging systems for shower doors and other panels, particularly where the above concerns are addressed.

SUMMARY OF THE INVENTION

In one aspect the present invention provides packaging for housing a panel (e.g., one or more shower doors). There is a main sheet of packaging material having a central section, and a first lateral side wrap section linked to the central section that is suitable to retain a first accessory (e.g., hardware) for the panel when the first lateral side wrap section is rolled up around the first accessory towards the central section (e.g., by folding along fold lines). There is also an end cover flap linked to the central section and foldable with respect thereto.

A first end cap is provided suitable to protect an end of the panel when the end cap is mounted thereon. The end cover flap of the main sheet is designed to help retain the end cap against an end of the panel when the panel is positioned in the packaging.

In preferred forms there is also a second such end cap and the main sheet of packaging material also has a second lateral side wrap section suitable to retain a second accessory (e.g., header rails) for the panel when the second lateral side wrap section is rolled up around the second accessory towards the central section, the second lateral side wrap section being on an opposed lateral side of the central section from the first lateral side wrap section.

The first and second such end caps, the first lateral side wrap section when rolled up, and the second lateral side wrap section when rolled up, along with the closed end cover flaps, collectively provide a protective frame for the panel. Further, the central section provides a rear protective cover while the front of the panel can be left open for inspection by the consumer.

In further refinements there may be a locking tab extending from the first end cap engaging the panel, and the end cap may cradle and buffer an end of the panel.

In another aspect of the invention there is provided a sheet of foldable material (e.g., cardboard) suitable (when folded) for use in housing a panel. The sheet has a central section for protecting a rear of the panel, a left side wrap structure for housing an accessory for the panel when the left side wrap structure is rolled towards the central section, and a right side wrap structure for housing another accessory for the panel when the right side wrap structure is rolled towards the central section. At least one of the left and right side wrap structures may have an indentable portion for changing the available volume inside a rolled up wrap structure.

We note that in this application we used the term "rolled." That term can cover literal rolling, or it can cover the equivalent achieved by folding along one or more fold lines and/or rolling.

There may also be a first foldable cover section at a first end of the central section, and a second foldable cover section at another end of the central section opposed to the first end.

The present invention is capable of protecting the shower doors or other panels during shipping and handling. There are multiple layers of packaging materials in those areas most susceptible to damage during shipping and handling (e.g., the outer frame edges). Further, key portions of the packaging system provide an increased crush zone that cradles the panel(s), thereby helping to absorb any impacts if the assembly is accidentally dropped.

There are also locking mechanisms to better secure the packaging to the panel(s). Further, there are means for better accommodating various size panels and hardware/headers.

The roll up wrap portions create cavities for small hardware, headers, documentation, and other items susceptible to theft or vandalism. These cavities hide these items from view of the consumer. Nevertheless, the main panels remain viewable even when packaged. As a result, there is less likelihood of a consumer trying to open packaging to appreciate aspects of the product.

We prefer to use this packaging to ship a pair of by-pass type shower doors, optionally with cardboard spacer(s) there between for buffering. However, it could be used to ship a single panel, or more than two panels, or could be used to ship other types of panels.

These and still other advantages of the present invention will be apparent from the detailed description and drawings. What follows are merely preferred embodiments of the present invention. To assess the full scope of the invention the claims should be looked to.

DETAILED DESCRIPTION OF THE PREFERRED EMBODIMENT(S)

Figure 1:
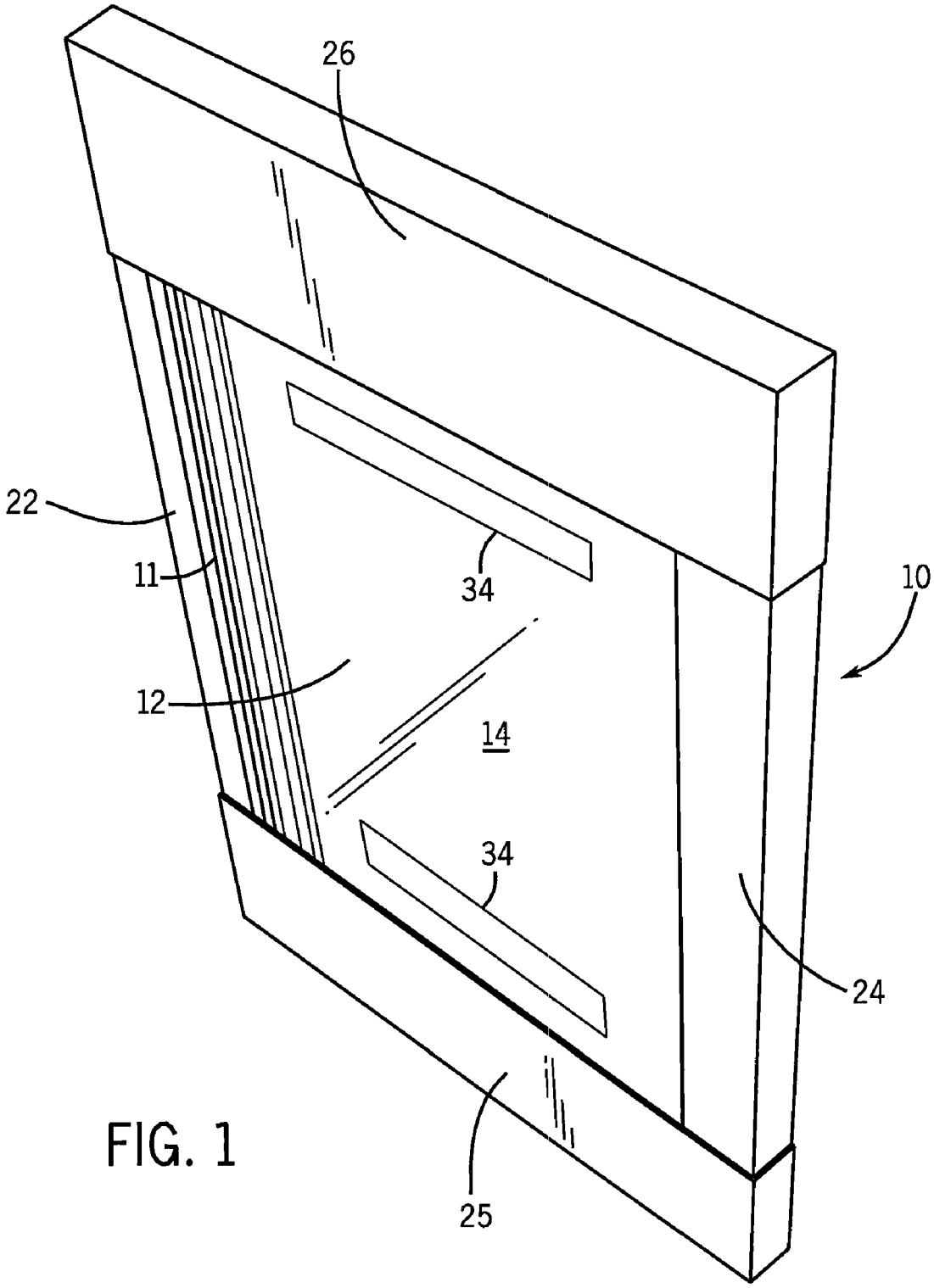
FIG. 1 is a perspective view of a packaging assembly of the present invention, in which two shower doors are packaged.

Turing first to FIG. 1, a packaging system 10 generally is shown as used with a pair of shower doors 12. The doors 12 have a glass portion 14 and a metal frame 11 that a consumer can view even when the product is packaged.

Figure 2:
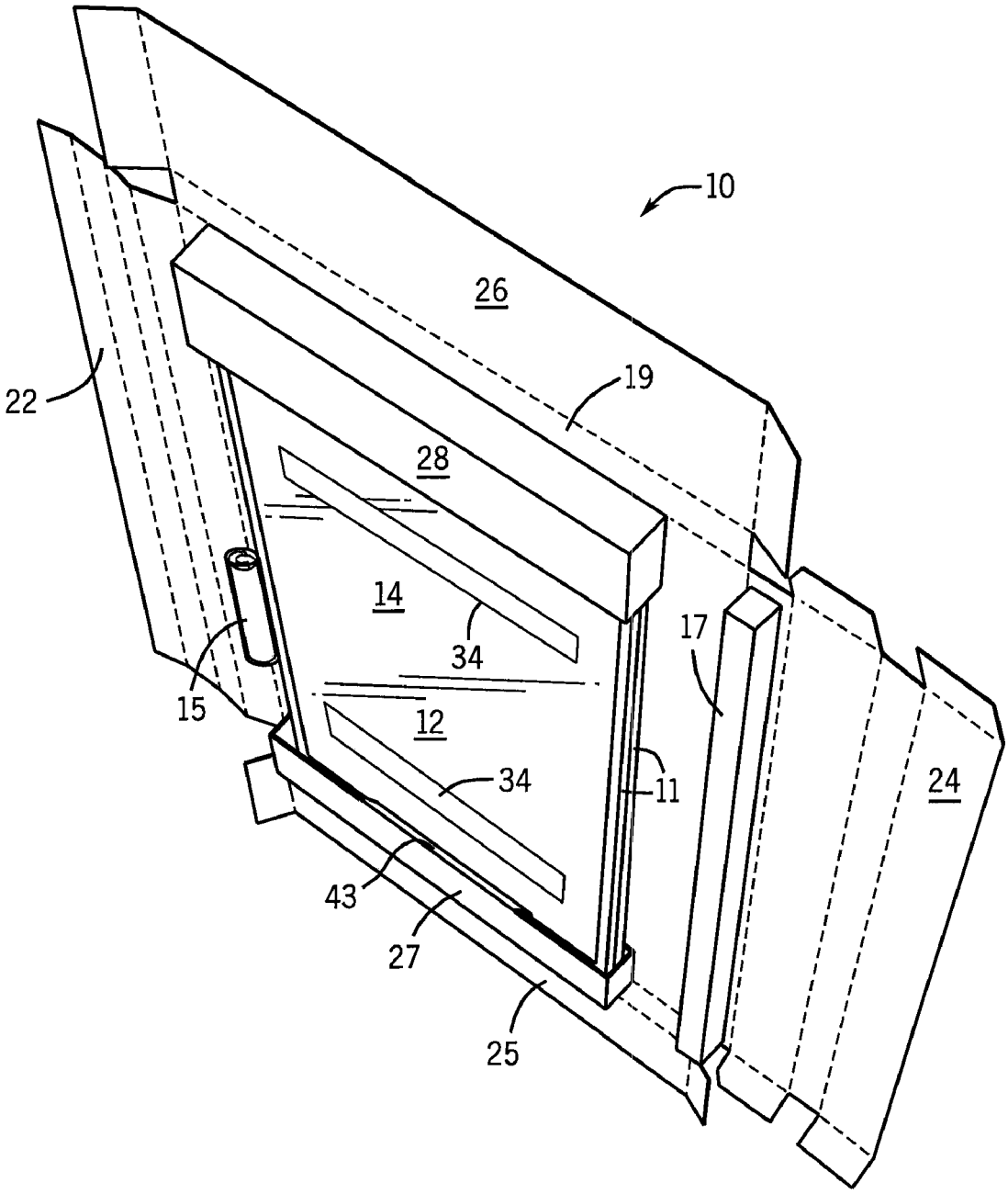
FIG. 2 is a view similar to FIG. 1, but with lateral side wraps rolled open, and with end cover flaps opened up.

As shown in FIG. 2 there can be associated hardware/documentation 15 on a first lateral side wrap 22 and a header rail 17 on a second lateral side wrap 24. In any event, there is a central section 20 connecting the wrap sections (see FIG. 6). There are also end cover flaps 25, 26. End caps 27, 28 are exposed when the end cover flaps 25, 26 are unfolded, as shown in FIG. 2.

Figure 3:
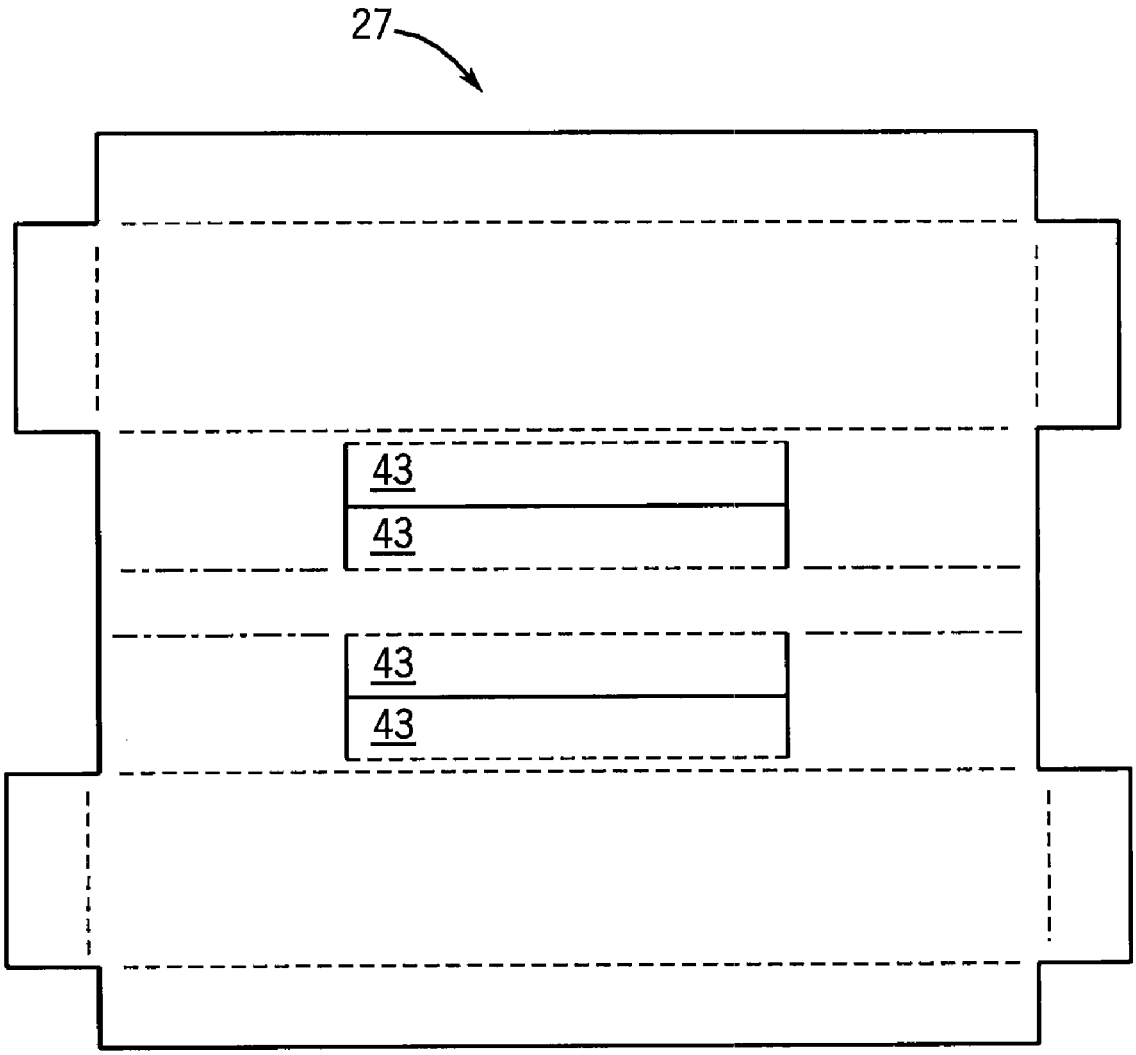
FIG. 3 is a top plan view of an end cap, in unfolded condition.
Figure 6:
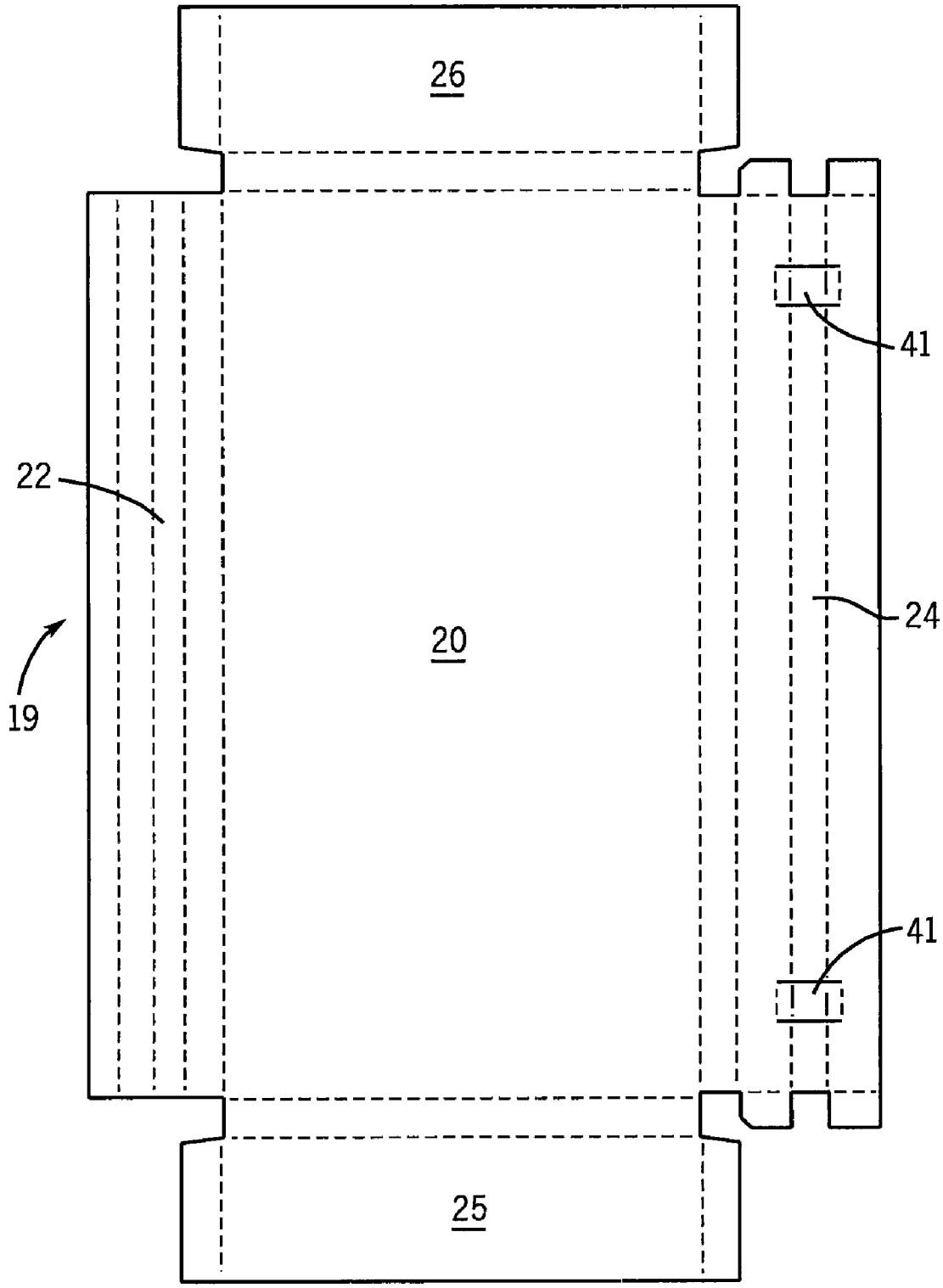
FIG. 6 is a top plan view of a main packaging sheet of FIG. 2, in unfolded condition.

As shown in FIGS. 3 and 6, the end caps 27, 28 and main sheet 19 can each be formed from foldable cardboard sheets. Appropriate scoring is provided to guide folding.

Figure 4:
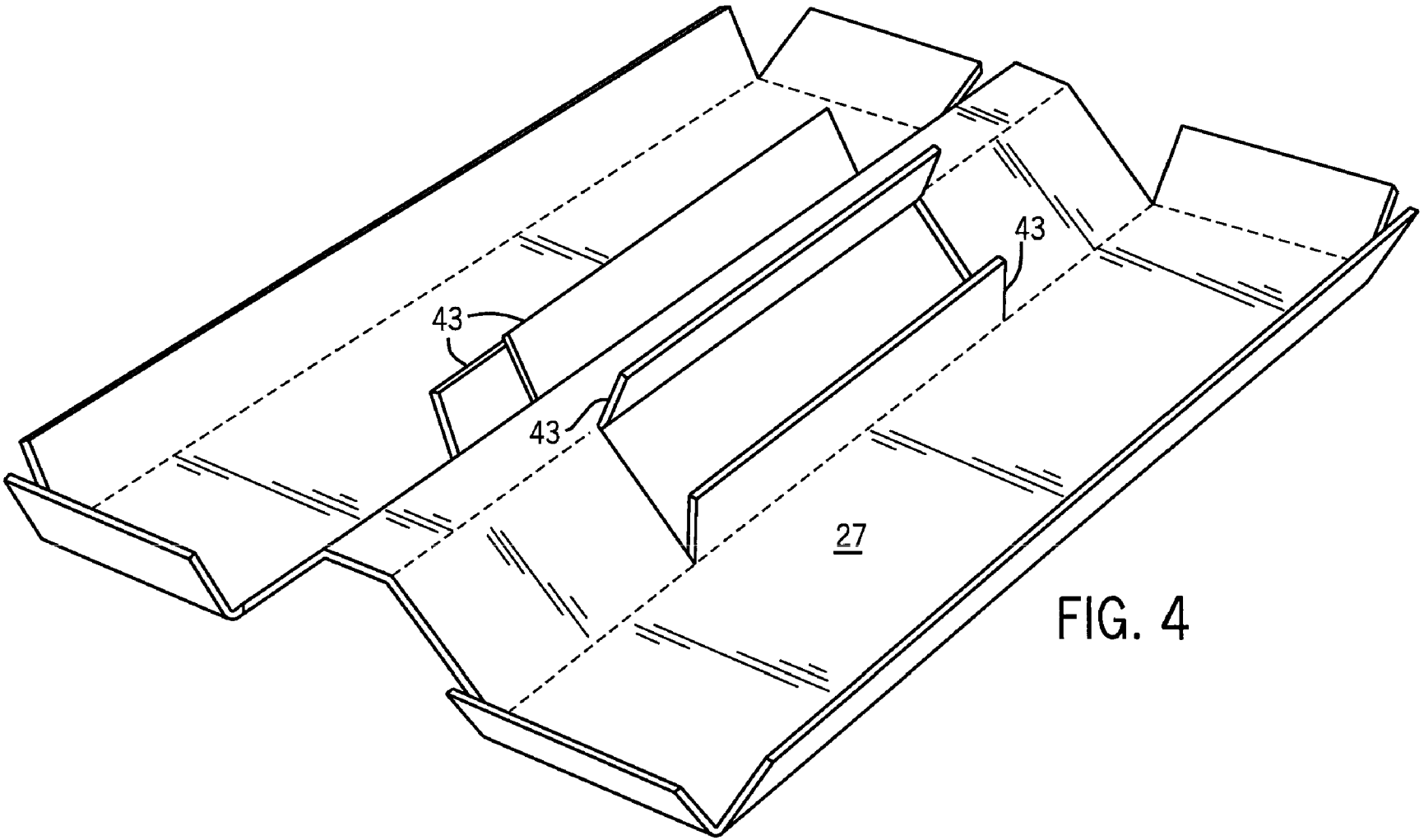
FIG. 4 is a perspective view of an end cap of the present invention, in process of being folded.
Figure 5:
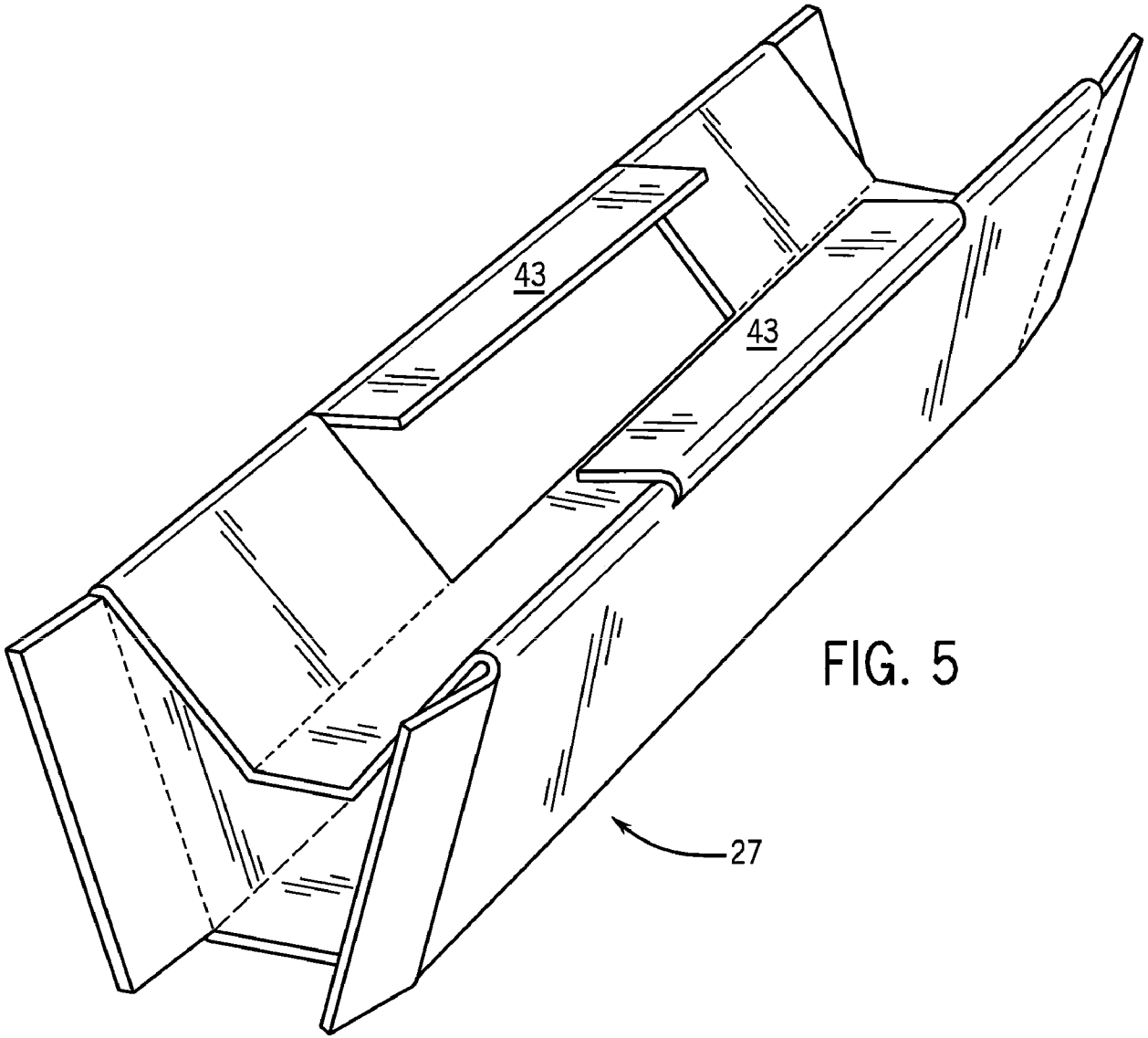
FIG. 5 is another perspective view of an end cap of the present invention, further folded.
Figure 11:
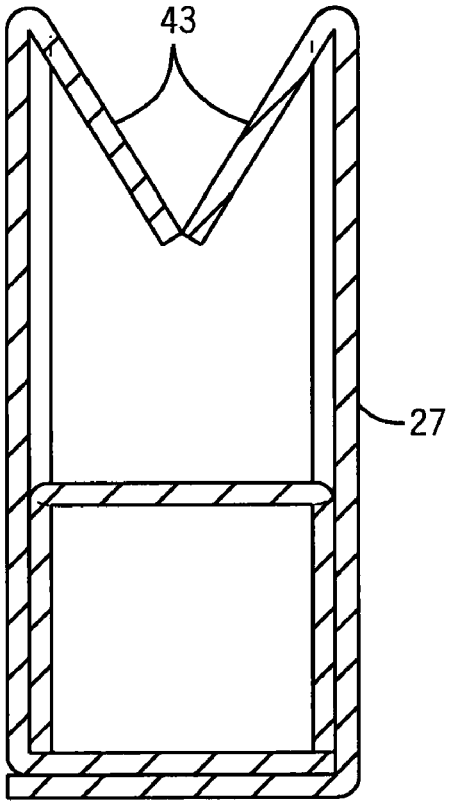
FIG. 11 is a view similar to FIG. 10, but before the end cap has been positioned on the panels.

With respect to an end cap 27 (that structure being the same for end cap 28) one starts with the FIG. 3 sheet. One then begins to fold as indicated in FIG. 4, then turning the folded structure as shown in FIG. 5. Tape can then be used to hold the structure in place in a configuration like that shown in FIG. 11.

Strips of spacer cardboard 34 (see FIG. 7) can be used to separate fragile glass surfaces. The end caps 27, 28 can then be placed on the top and bottom ends of the shower doors 12.

Figure 7:
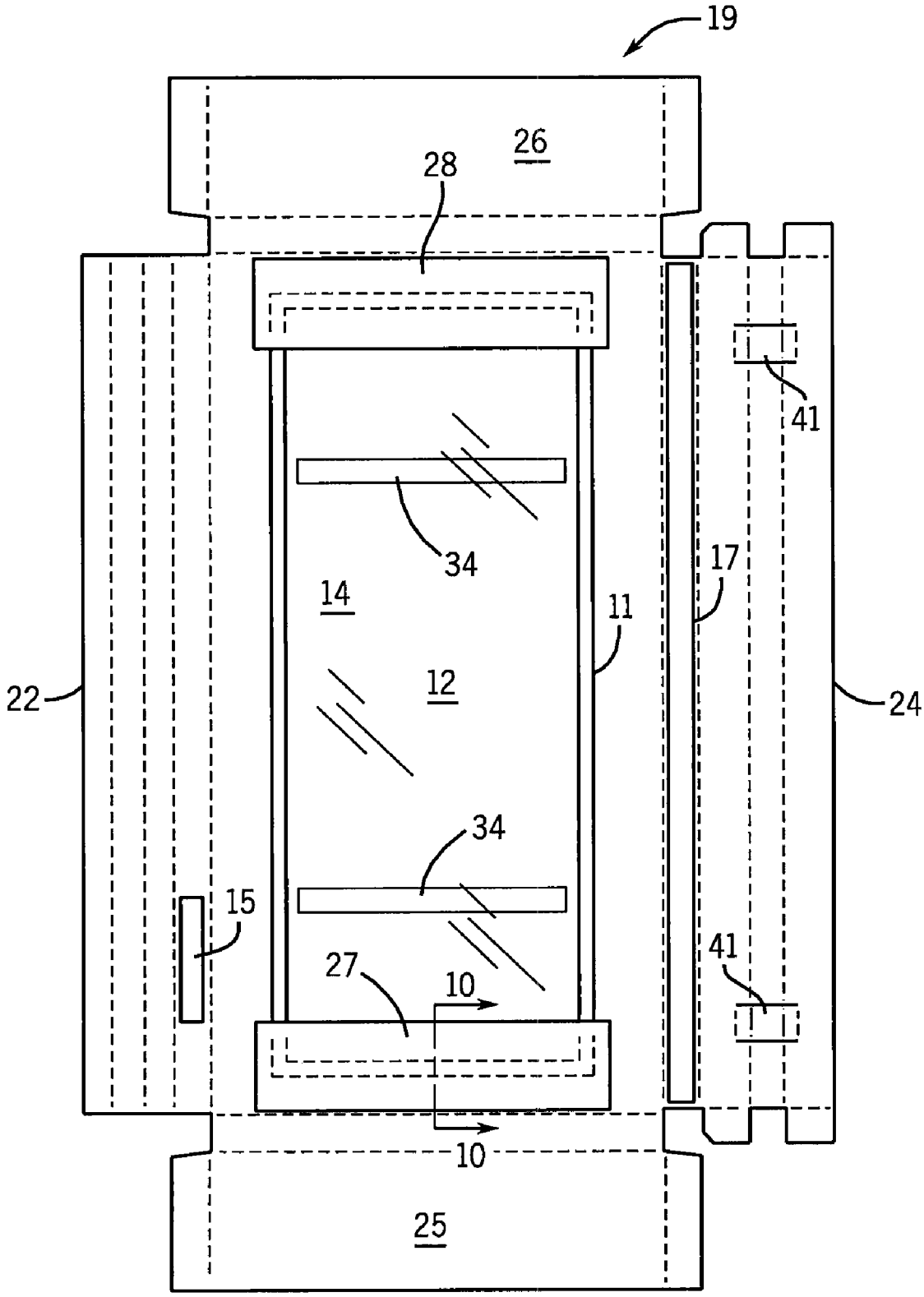
FIG. 7 is a view similar to FIG. 6, but with a subassembly of end caps and shower doors placed thereon.
Figure 8:
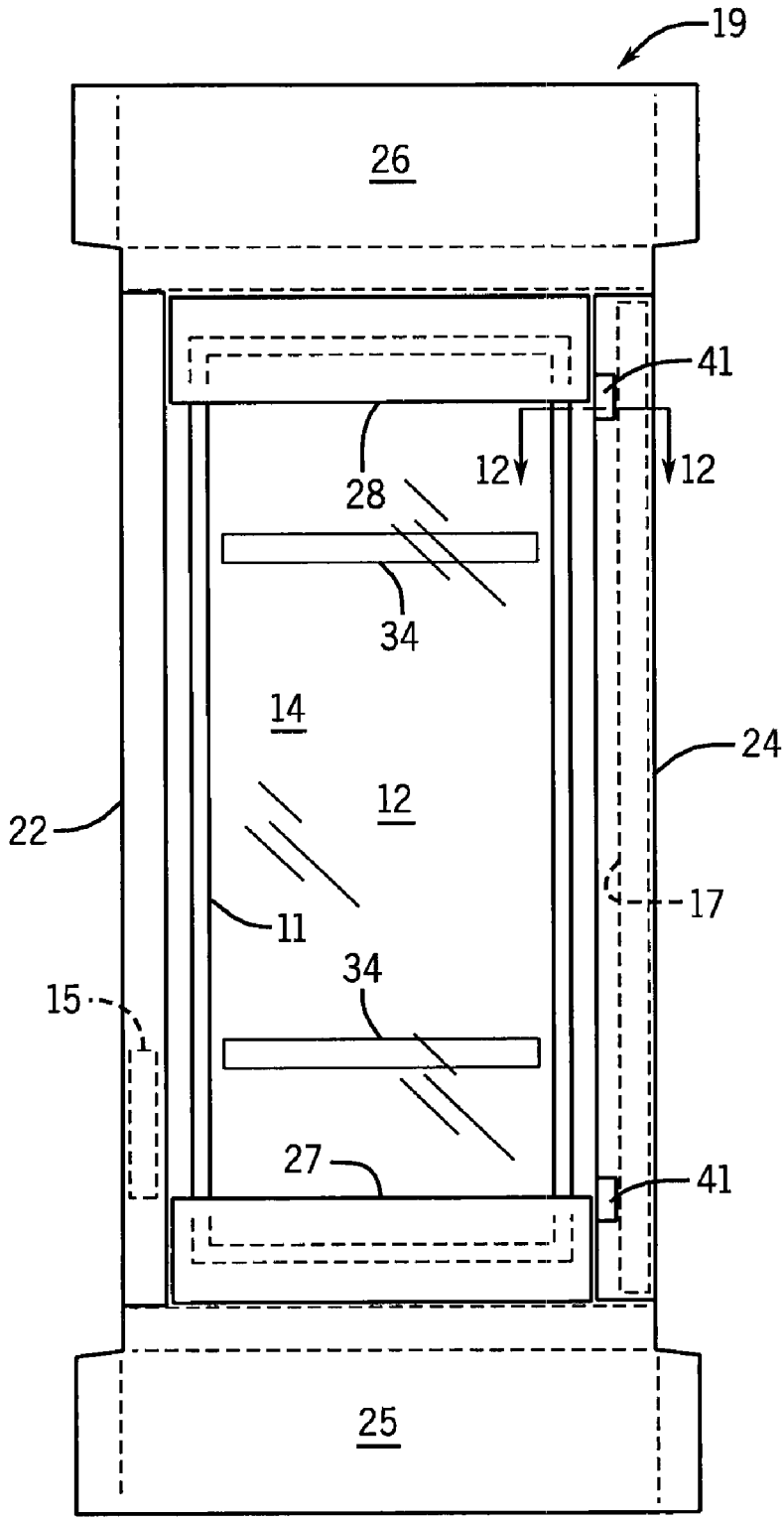
FIG. 8 is a view similar to FIG. 7, but with the lateral side wraps rolled up.
Figure 9:
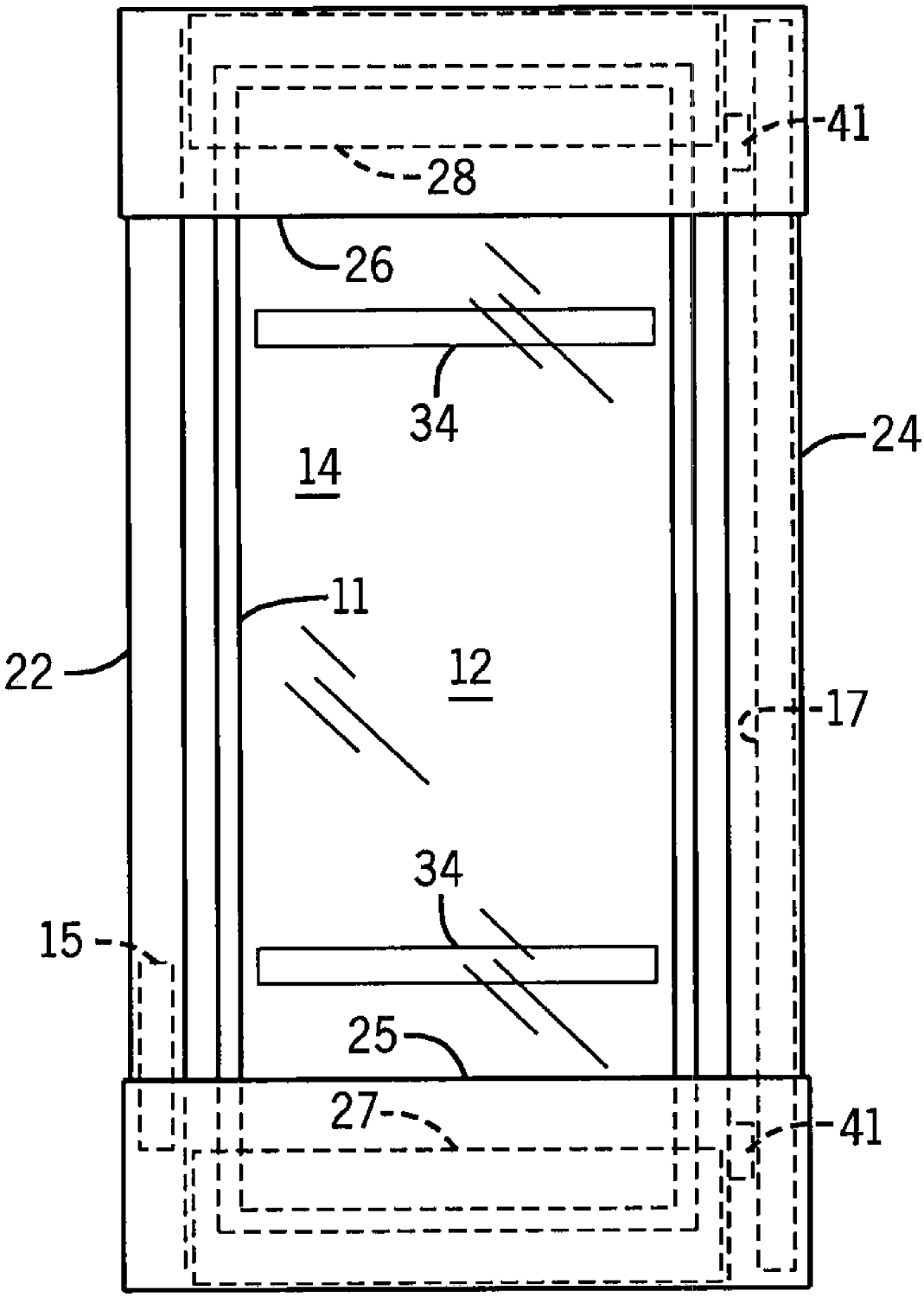
FIG. 9 is a view similar to FIG. 8, but with end cover flaps folded over to complete the frame as shown in FIG. 1.

The end cap/shower door subassembly can then be placed on the main sheet as shown in FIG. 7. Then, the accessories/documentation 15 and the header rail 17 can be positioned as shown in FIG. 2. After this, lateral side wraps 22, 24 can be rolled up using their fold lines to surround these items. This will result in the FIG. 8 configuration. Then, the end cover flaps 25, 26 can be folded over and taped in place to achieve the FIG. 9 frame structure.

Figure 10:
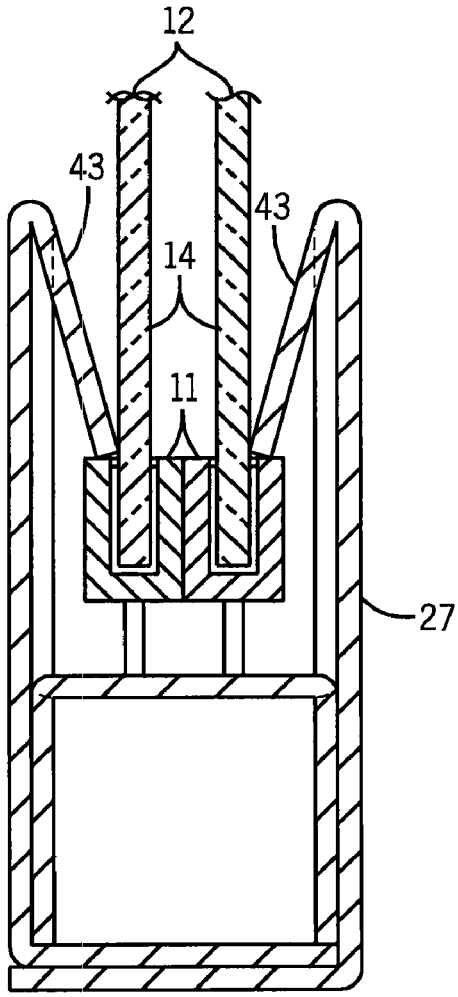
FIG. 10 is a vertical sectional view taken along line 10-10 of FIG. 7 and inverted.
Figure 12:
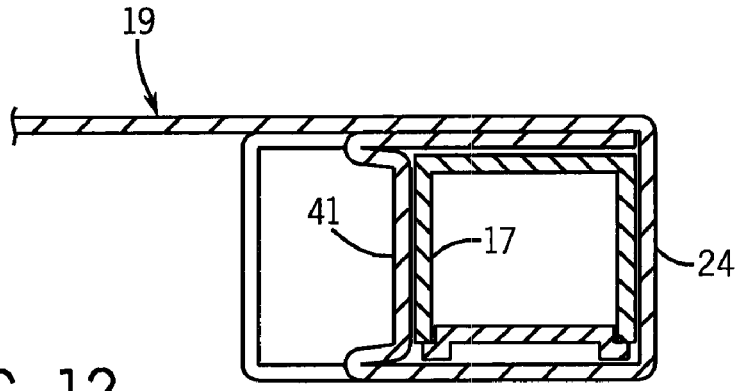
FIG. 12 is a view taken along line 12-12 of FIG. 8.

As shown in FIG. 10, this will result in the ends of the door panels 12 being cradled and buffered in the end caps 27, 28, with further protection from the cover flaps 25, 26. Also, as shown in FIG. 12, and as will be appreciated from FIG. 6, there are some punch-in regions 41 on one of the roll up sections that can be used to further restrict the volume of the internal cavity formed by the roll up if desired.

It should be noted from FIG. 5 and FIG. 10 that the end cap 27, 28 forms locking tabs 43 that help provide positive positioning of the end caps 27, 28 on the shower doors 12 and facilitate handling of the door/end cap subassembly. It is particularly interesting that the end caps 27, 28 not only are "locked" onto the ends of the doors 12, the end caps 27, 28 also serve to cradle the door end, and also buffer them with an air cell.

Figure 13:
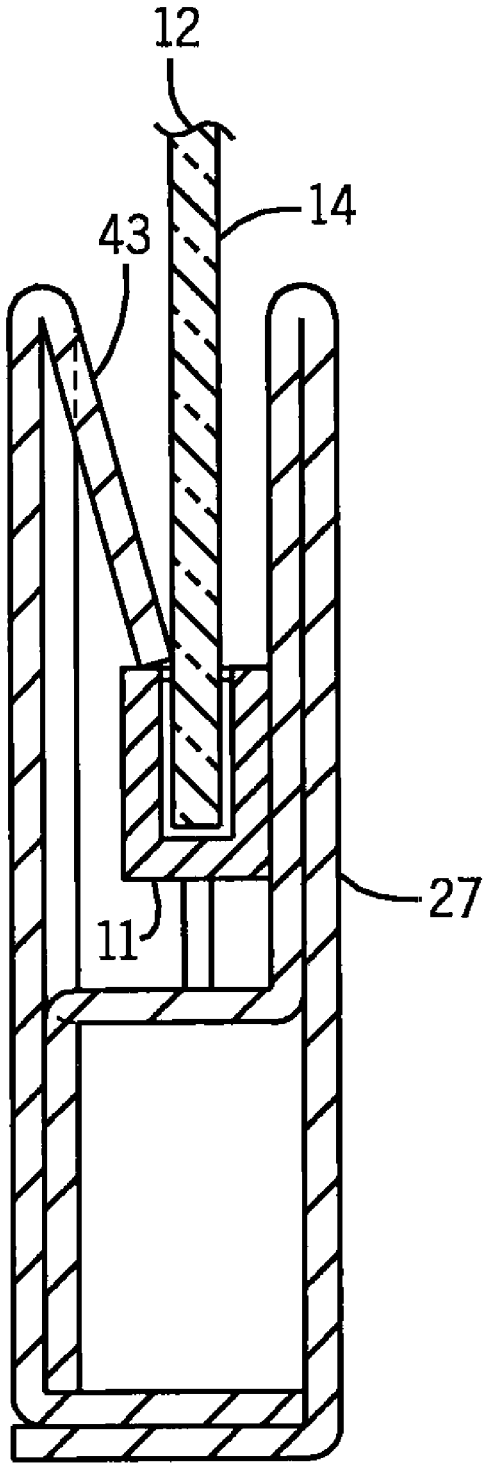
FIG. 13 is a view similar to FIG. 10, but of an alternative end cap configured to accept a single panel, where only a single panel is housed.

FIG. 13 shows an alternative embodiment in which only one panel 12 is packaged.

Hence, various deficiencies of the prior art are overcome by the present invention. It should be appreciated that only preferred embodiments of the invention have been described above and depicted in the enclosed drawings. However, many modifications and variations to the preferred embodiments will be apparent to those skilled in the art, which will be within the spirit and scope of the invention.

Therefore, the invention should not be limited to just the described embodiments. To ascertain the full scope of the invention, the following claims should be referenced.

INDUSTRIAL APPLICABILITY

The invention provides improved packaging assemblies for shower doors and the like.

We claim:

1. Packaging assembly, comprising:

a panel having a portion bordered by a frame;

a sheet of packaging material having:

(i) a central section;

(ii) a first lateral side wrap section linked to the central section and retaining a first accessory for the panel when the first lateral side wrap section is rolled up around the first accessory towards the central section; and (iii) an end cover flap also linked to the central section and foldable with respect thereto; and a first end cap suitable to protect an end of the panel, the end cover flap helping in retaining the first end cap against the panel;

the assembly further comprising a pair of locking tabs extending from opposite sides of the first end cap which both catches on the frame on opposite sides of the frame and thereby both helps lock the first end cap to the panel.

2. The packaging assembly of claim 1, wherein the sheet of packaging material also has a second lateral side wrap section retaining a second accessory for the panel when the second lateral side wrap section is rolled up around the second accessory towards the central section, the second lateral side wrap section being linked to the central section on an opposed lateral side thereof from where the first lateral side wrap section is linked to the central section.

3. The packaging assembly of claim 1, further comprising a second end cap mountable at an opposed end of the first lateral side wrap section than the first end cap is mounted.

4. The packaging assembly of claim 3, wherein the packaging assembly provides a further protective frame for the panel.

5. The packaging assembly of claim 4, wherein the central section provides a rear protective cover for the panel.

* * * * *

UNITED STATES PATENT AND TRADEMARK OFFICE

CERTIFICATE OF CORRECTION

PATENT NO. : 7,748,527 B2
APPLICATION NO. : 11/955722
DATED : July 6, 2010
INVENTOR(S) : Mark A. Wisecarver et al.

It is certified that error appears in the above-identified patent and that said Letters Patent is hereby corrected as shown below:

Replace claims 1 and 3 in column 4 with the following:

Lines 27-44

--1. Packaging assembly, comprising:

a panel having a portion bordered by a frame;

a sheet of packaging material having:

(i) a central section;

(ii) a lateral side wrap section linked to the central section and retaining an accessory for the panel when the lateral side wrap section is rolled up around the accessory towards the central section; and (iii) an end cover flap also linked to the central section and foldable with respect thereto; and an end cap suitable to protect an end of the panel, the end cover flap retaining the end cap against the panel;

the assembly further comprising a pair of locking tabs extending from opposite sides of the end cap which both catch on the frame on opposite sides of the frame and thereby both lock the end cap to the panel;

wherein the end cap provides an air cell buffer at an end of the panel.--

Lines 54-55

--3. The packaging assembly of claim 1, further comprising a second end cap mountable at an opposed end of the panel from where the other end cap is mounted; wherein the second end cap also provides an air cell buffer at an end of the panel.--

Signed and Sealed this

Third Day of August, 2010

David J. Kappos

David J. Kappos
*Director of the United States Patent and Trademark Office*